United States Patent [19]

Hayakawa et al.

[11] 4,367,574

[45] Jan. 11, 1983

[54] FLUORESCENT TUBE HOLDER

[75] Inventors: Masatoshi Hayakawa, Nagoya; Koei Ogi, Komaki; Michio Takahara, Iwakura, all of Japan

[73] Assignee: CKD Corporation, Komaki, Japan

[21] Appl. No.: 178,110

[22] Filed: Aug. 14, 1980

[30] Foreign Application Priority Data

Jan. 10, 1980 [JP] Japan ..... 55-1702

[51] Int. Cl.[3] ..... H01J 9/06

[52] U.S. Cl. ..... 29/25.19; 29/281.1; 269/225; 269/254 CS

[58] Field of Search ..... 29/25.19, 25.20, 281.1, 29/281.2; 269/225, 254 CS; 198/653

[56] References Cited

U.S. PATENT DOCUMENTS

| | | | |
|---|---|---|---|
| 774,563 | 11/1904 | Clark | 269/225 |
| 2,564,897 | 8/1951 | Hahn | 29/25.19 |
| 2,595,058 | 4/1952 | Daley | 29/25.19 X |
| 2,665,894 | 1/1954 | Baker et al. | 29/25.19 X |
| 2,923,050 | 2/1960 | Dwinell et al. | 29/25.19 |
| 4,031,598 | 6/1977 | Summers et al. | 29/25.19 |

*Primary Examiner*—Howard N. Goldberg
*Assistant Examiner*—Fred A. Silverberg
*Attorney, Agent, or Firm*—Wenderoth, Lind & Ponack

[57] ABSTRACT

A fluorescent tube holder comprises a fluorescent tube holding chuck having a pair of releasable claws for holding the fluorescent tube, and a base chuck having a pair of releasable claws for holding the base of the fluorescent tube on the outer periphery thereof. The base chuck is movable toward and away from an end of the fluorescent tube held by said fluorescent tube holding chuck.

7 Claims, 4 Drawing Figures

FLUORESCENT TUBE HOLDER

BACKGROUND OF THE INVENTION

1. Field of the Invention

The present invention relates to a fluorescent tube holder for a fluorescent tube base mounting apparatus used in the manufacture of fluorescent lamps, and more particularly, to the fluorescent tube holder used for securely holding and transporting the fluorescent tube and the bases therefor with the leads emerging from ends of the fluorescent tube inserted into the base pins in the fluorescent tube base mounting apparatus.

2. Description of the Prior Art

In the conventional manufacture of fluorescent lamps, in order that the fluorescent tube and the bases therefor are adhered together in subsequent steps, it was the general practice in a base mounting apparatus to insert leads for the filament coil emerging from an end of the fluorescent tube together with base pins into the bases which are supported at the ends of the fluorescent tube during the intermediate steps in which the fluorescent tubes were held and transported by a number of fluorescent tube holders provided at equal distances in the conveyor chains. However, since the leads themselves were weak and there was no particular means provided to hold the bases securely, the conventional base mounting apparatus had a serious disadvantage that the bases supported in this manner easily separated or fell apart from the fluorescent tube in the course of transportation, thereby making it impossible to mount the bases reliably and securely at high speed.

SUMMARY OF THE INVENTION

Accordingly, an object of the present invention is to overcome the disadvantage of a reduction in efficiency of the base adhering operation caused heretofore by accidental falling off of the base from the fluorescent tube, by providing a fluorescent tube holder capable of reliably and securely supporting the fluorescent tube and bases therefor with the base pins thereof inserted through leads in the fluorescent tube base mounting apparatus.

The fluorescent tube holder according to the present invention is characterized in that it comprises a fluorescent tube holding chuck having a pair of releasable claws for holding the fluorescent tube, and a base chuck having a pair of releasable claws for holding the base of the fluorescent tube on the outer periphery thereof, in which the base chuck is movable toward and away from an end of the fluorescent tube held by the fluorescent tube holding chuck.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

The preferred embodiment of the fluorescent tube holder according to the present invention will now be described in detail with reference to the drawings.

Figure 1:
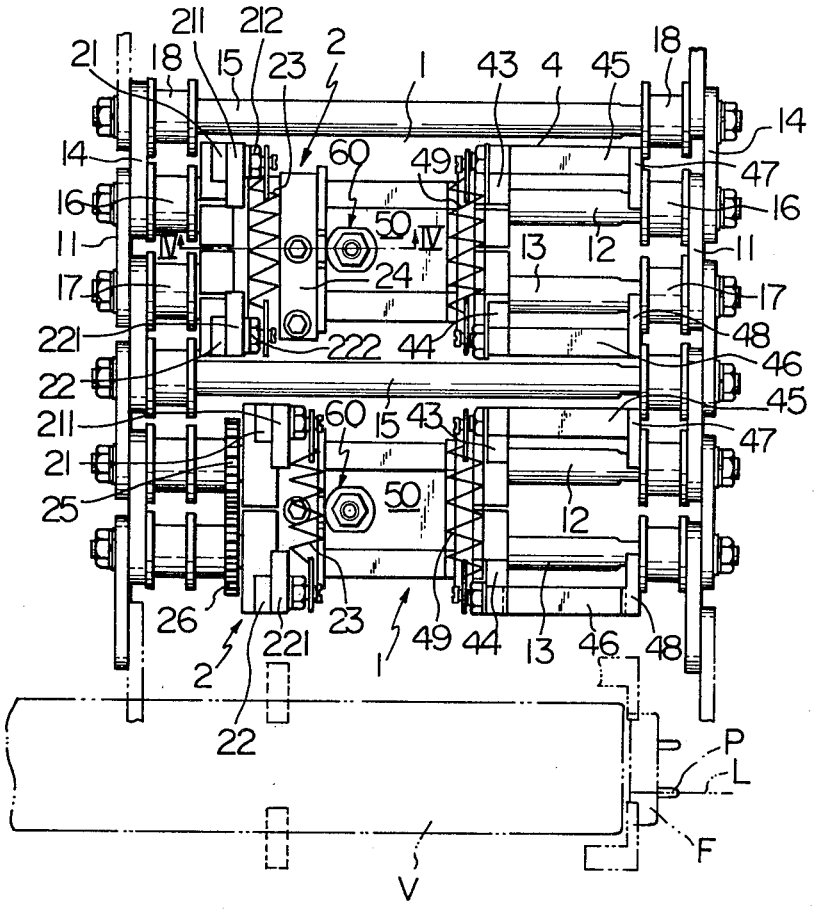
FIG. 1 is a plan view of fluorescent tube holders according to the present invention, showing the holders used in only one end of each of the fluorescent tubes.

In FIG. 1 there are illustrated fluorescent tube holders according to the present invention. While the holders are provided symmetrically on both ends of the fluorescent tube, the holders on one end only of the fluorescent tube are shown in FIG. 1 for the sake of simplification. In the drawings, reference numeral 1 generally denotes each of a plurality of fluorescent tube holders according to the embodiment of the present invention, which comprises a fluorescent tube chuck 2 and a base chuck 4, both being held by a pair of longitudinally extending shafts 12 and 13 connected at both ends thereof in parallel to each other by links 11. Successive pairs of shafts 12 and 13 of successive holders are connected through links 14 to adjacent shafts 15 successively into an endless chain which extends in a closed path, perpendicular to the longitudinal extent of shafts 12, 13 and 15. The shafts 12, 13 and 15 are respectively provided at both ends thereof with rollers 16, 17 and 18 for chain gears. The linked shafts 12, 13 and 15 may be advanced by suitable means in the closed path.

Figure 2:
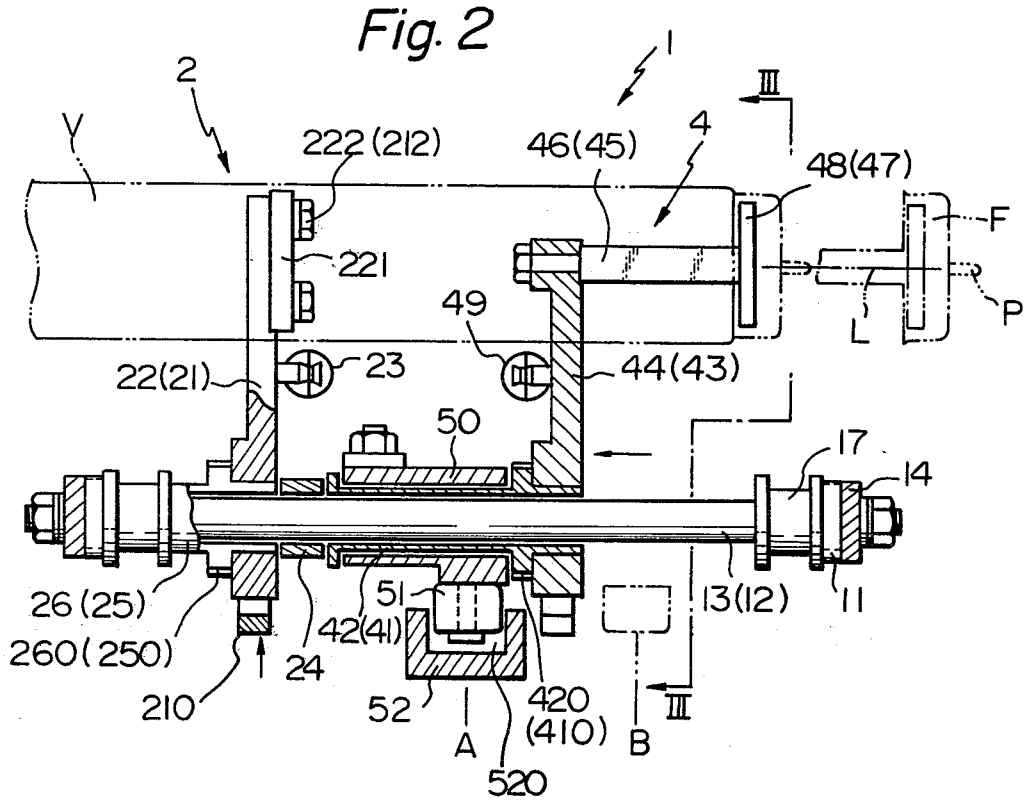
FIG. 2 is a sectional side elevation of the fluorescent tube holder of FIG. 1.
Figure 3:
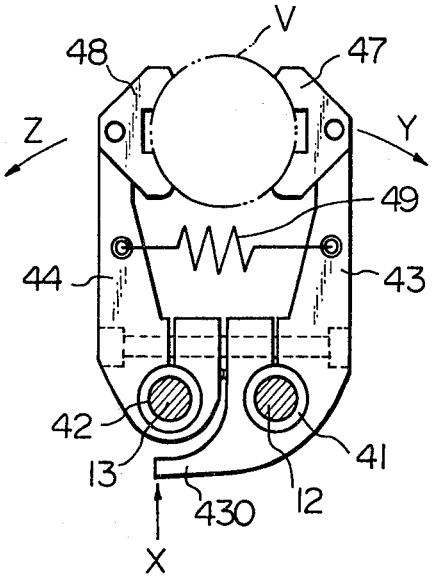
FIG. 3 is an end view taken along line III—III of FIG. 2.

As shown in FIGS. 1, 2 and 3, the fluorescent tube chuck 2 has a pair of arms 21 and 22 mounted pivotally on the shafts 12 and 13, respectively, through sleeves 25 and 26, respectively. The arms 21 and 22 are provided at upper ends thereof with claws 211 and 221, respectively, secured by set screws 212 and 222, respectively.

The arms 21 and 22 are urged toward each other by a spring 23 at their tip ends (upper ends in FIG. 2) so as to cooperate to hold a fluorescent tube V. Arms 21 and 22 are respectively secured to the sleeves 25 and 26, on which inter-meshing gears 250 and 260, are respectively formed concentrically with the respective shafts 12 and 13. These arms 21 and 22 are prevented from axial movement by a connector member 24 fixed to the shafts 12 and 13, but are pivotable about the shafts. When a projection 210 formed at a rear end (lower end) of the arm 21 is pushed by an external actuating means (not shown), the arms 21 and 22 are simultaneously moved apart (through the gears) to hold or release the fluorescent tube.

The base chuck 4 comprises sleeves 41 and 42 mounted rotatably and axially (longitudinally) movably on the shafts 12 and 13, respectively, arms 43 and 44 fixed at ends (rightward ends in FIG. 2) of the sleeves 41 and 42, respectively, claws 47 and 48 fixed at forward ends (upper ends in FIG. 2) of the arms 43 and 44, respectively, through axially extending rods 45 and 46, respectively, and a connector plate 50 on which the sleeves 41 and 42 are mounted. The claws 47 and 48 may be formed integrally with the arms 43 and 44, respectively.

The sleeves 41 and 42 are respectively formed with inter-meshing gears 410 and 420.

The arms 43 and 44 are urged toward each other by a spring 49 at the tip ends thereof so that the claws 47 and 48 can cooperate with each other to hold a base F. As is illustrated in FIG. 3, arm 43 has a projection 430 formed (in the same form as the projection 210 of the arm 21) at the lower end thereof. By urging the projection 430 in the direction X by means of an external means (not shown), the claws 47 and 48 may be opened apart in the directions Y and Z, respectively, so as to hold or release the base F.

Mounted rotatably on the underside of the connector plate 50 is a roller 51 which is received in a groove 520 of a cam plate 52 provided along the direction of advancement of the fluorescent tube holder which extends along the closed path of the endless chain of shafts 12, 13 and 15. Groove 520 curves back and forth between longitudinal positions A and B along the direction of advancement of the tube holder so that roller 51 rolls in the groove 520 causes the entire base chuck 4 to slide on the shafts 12 and 13 between positions A and B.

Figure 4:
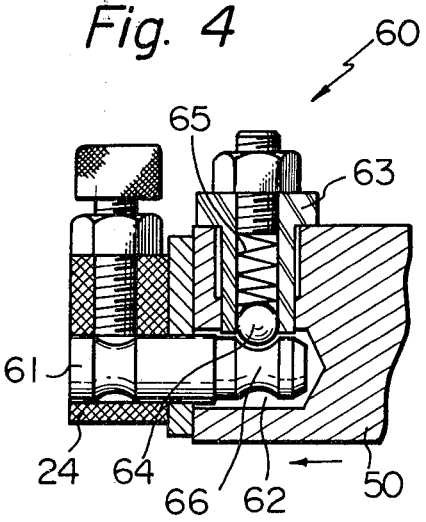
FIG. 4 is a side elevation taken along line IV—IV of FIG. 1, showing a detent mechanism for fittingly stopping the fluorescent tube base chuck sideways.

On the connector member 24 and the connector plate 50 is provided a detent mechanism 60 for holding the base chuck at a base mounting position (shown in FIG. 2). As shown in FIG. 4, the detent mechanism 60 comprises a shaft 61 projecting from the connector member 24 securely into the connector plate 50 between the shafts 12 and 13, a cavity 62 formed in the connector plate 50 for receiving the shaft 61, a sleeve 63 mounted on the connector plate 50, and a ball 64 inserted into the sleeve 63 and urged toward the cavity 62 by the spring 65. When the base chuck is in the mounting position and the shaft 61 enters the cavity 62, the ball engages with a peripheral groove 66 on the shaft 61 to prevent the axial movement of the base chuck.

The operation of the fluorescent tube holder having the construction described above will now be explained. A fluorescent tube V is held and transported by the fluorescent tube chuck 2 in a horizontal longitudinally extending orientation (parallel to shafts 12, 13 and 15), with a pair of leads L extending from an end thereof and directed horizontally as required. The claws 47 and 48 of the base chuck 4 have been advanced to the position shown by broken lines in FIG. 2 by moving the roller 51 to the position B. The base chuck 4 at this advanced position is opened apart by pushing the projection 430 upward to hold the base F prepared by known means, during which operation the leads L are inserted into a base pin P, and during the continued movement of the fluorescent tube holder 1 the roller 51 is returned to the position A and the base F is mounted to the end of the fluorescent tube V. Since the base chuck 4 is held at the mounting position by the detent mechanism 60 described hereinabove, the base F hereafter stays fitted into the end of the fluorescent tube. Furthermore, operation of the roller 51 is no longer necessary. The base thus combined is welded in the subsequent steps.

As will be apparent from the foregoing description, the fluorescent tube holder according to the present invention provides important advantages such as reliable and efficient mounting of the bases and efficient and speedier adhering in the succeeding step because the unsteady holding of the bases to the fluorescent tubes through leads in the conventional apparatus is eliminated in the apparatus according to the present invention.

While we have shown and described specific embodiment of our invention, it will be understood that these embodiments are merely for the purpose of illustration and description and that various other forms may be devised within the scope of our invention, as defined in the appended claims.

We claim:

1. A fluorescent tube holder, comprising:

a fluorescent tube holding chuck having a first pair of releasable claws for holding a fluorescent tube in a longitudinally extending direction;

a base holding chuck having a second pair of releasable claws for holding a base for the fluorescent tube on the outer periphery thereof, said base holding chuck being movable in said longitudinally extending direction toward and away from an end of the fluorescent tube;

said fluorescent tube holding chuck and said base holding chuck being advanceable in a first direction; and means, including a body pivotally receiving said base holding chuck, a roller rotatably mounted on said body, and a cam provided along said first direction and engaging said roller, for moving said base holding chuck in said longitudinally extending direction toward and away from said end of the fluorescent tube during advancement of said fluorescent tube holding chuck and said base holding chuck in said first direction.

2. A fluorescent tube holder as in claim 1, wherein said first direction is perpendicular to said longitudinally extending direction.

3. A fluorescent lamp tube holder, advanceable in a first direction, comprising:

a first pair of parallel shafts;

a fluorescent lamp tube holding chuck for holding a fluorescent lamp tube in parallel with said first pair of shafts, said tube holding chuck inlcuding:

a first pair of arms pivotally mounted on said first pair of shafts, first spring means for urging each arm of said first pair of arms toward the other at one end thereof, each arm of said first pair of arms having a claw fixed to the other end thereof, and first inter-meshing gears respectively fixed to separate arms of said first pair of arms;

a base holding chuck for holding a fluorescent lamp tube base in axial alignment with said fluorescent lamp tube, said base chuck including:

a pair of sleeves mounted pivotally and axially movable on said first pair of shafts, a second pair of inter-meshing gears respectively formed on separate sleeves of said pair of sleeves, a pair of claws, a second pair of arms, each arm of said second pair of arms being fixed at one end to a separate one of said pair of sleeves, having a separate one of said pair of claws mounted to its other end, and second spring means for urging each arm of said second pair of arms toward the other at the other end thereof;

a body pivotally receiving said pair of sleeves; and means, including a rotatable roller mounted on said body and a cam plate provided along said first direction engaging with said roller, for axially moving said base holding chuck.

4. A fluorescent lamp tube holder as in claim 3, further comprising a detent mechanism for holding said base holding chuck in a predetermined position with respect to said tube holding chuck.

5. A fluorescent lamp tube holder as in claim 4, wherein said detent mechanism includes a connector member, fixed between said first pair of shafts, and a rod fixed to said connector member, a cavity being formed in said body and adapted to receive said rod therein, a ball, and means for urging said ball into engagement with said rod within said cavity, whereby said detent mechanism holds said base holding chuck in said predetermined position.

6. A fluorescent tube holder as in claim 3 or claim 4 or claim 5, further comprising successively adjacent parallel additional pairs of shafts, adjacent to and parallel with said first pair of parallel shafts, and links, respectively linking adjacent pairs of said first and additional pairs of shafts with said separate ones of said connecting shafts, to form an endless chain, each of said additional pairs of shafts being provided with a separate fluorescent tube holding chuck and a separate base holding chuck.

7. A fluorescent tube holder as in claim 3 or claim 4 or claim 5, wherein the direction of axial movement of said pair of sleeves on said first pair of shafts is perpendicular to said first direction.

* * * * *